United States Patent [19]

Eckert

[11] Patent Number: 5,040,511

[45] Date of Patent: Aug. 20, 1991

[54] FUEL INJECTION DEVICE FOR INTERNAL COMBUSTION ENGINES, IN PARTICULAR UNIT FUEL INJECTOR

[75] Inventor: Konrad Eckert, Stuttgart, Fed. Rep. of Germany

[73] Assignee: Robert Bosch GmbH, Stuttgart, Fed. Rep. of Germany

[21] Appl. No.: 527,406

[22] Filed: May 22, 1990

[30] Foreign Application Priority Data

Jul. 14, 1989 [DE] Fed. Rep. of Germany ..... 3923271

[51] Int. Cl.[5] ..... F02M 59/32

[52] U.S. Cl. ..... 123/446; 123/501; 239/95

[58] Field of Search ..... 123/446, 447, 467, 501; 239/88, 89, 90, 91, 92, 93, 94, 95, 96

[56] References Cited

U.S. PATENT DOCUMENTS

| | | | |
|---|---|---|---|
| 4,235,374 | 11/1980 | Walter et al. | 239/90 |
| 4,425,894 | 1/1984 | Kato | 123/446 |
| 4,531,672 | 7/1985 | Smith | 123/446 |
| 4,951,631 | 8/1990 | Eckert | 123/446 |
| 4,976,244 | 12/1990 | Eckert | 123/501 |

FOREIGN PATENT DOCUMENTS

| | | |
|---|---|---|
| 3700352 | 7/1988 | Fed. Rep. of Germany . |
| 3700359 | 7/1988 | Fed. Rep. of Germany . |

*Primary Examiner*—Carl Stuart Miller
*Assistant Examiner*—Erick Solis
*Attorney, Agent, or Firm*—Edwin E. Greigg; Ronald E. Greigg

[57] ABSTRACT

A fuel injection device of for internal combustion engines, particularly a unit fuel injector, having a pump piston preferably driven via a drive cam and having a free piston hydraulically driven by the pump piston, the free piston divides a pump chamber from a pressure chamber, from which a pressure line leads to an injection nozzle of the engine. Via a magnetic valve, the fuel to be injected is first metered into the pressure chamber during the intake stroke of the pump piston and subsequently, in the control stroke, an injection quantity determining the supply onset is metered into the pump chamber. The pump piston with spaced annular grooves serves as a reversal device. During the metering stroke, a maintenance pressure that is lower than the metering pressure of the fuel and is generated via a pressure control valve is maintained in the pump chamber.

22 Claims, 2 Drawing Sheets

FUEL INJECTION DEVICE FOR INTERNAL COMBUSTION ENGINES, IN PARTICULAR UNIT FUEL INJECTOR

BACKGROUND OF THE INVENTION

The invention is based on a fuel injection device for internal combustion engines, in particular a unit fuel injector, as defined hereinafter.

Generic Injection devices, particularly when embodied as unit fuel injectors are used particularly where high injection pressures and the simplest possible adaptability of the course of injection to the engine combustion course requirements, dictated by various parameters, are needed. Existing requirements involve not only the compressibility of the fuel, which has a more pronounced effect on the injection principle because of the high injection pressure, and the resultant influences on the course of injection above all they involve great freedom in adaptability of the onset and end of injection. Normally in these fuel injection devices the drive cam is disposed on the engine camshaft, on the one hand to bring the high drive forces to bear with as little loss as possible and on the other hand to obtain control of the injection device as a function of the rotational angle in a manner that functions as synchronously as possible with the valve control. This rotational angle-dependent control has superimposed on it the flexible timing control of the fuel metering device, which is preferably in the form of a magnetic valve, to enable making the appropriate closed- and open-loop control interventions via an electronic control unit. Preferably the trailing flank of the drive cam (intake stroke) is embodied as relatively long; it encompasses a wide rotational angle, so that a relatively long period of time is available for control via the fuel metering device during the intake stroke. A number of variants of such injection devices are known.

In a known unit fuel injector of the type set forth by (German Offenlegungsschrift 37 00 352), the pump piston serves as the control device; via an annular groove disposed on its jacket face, during a metering segment of the intake stroke of the pump piston, the metering conduit communicates with the pressure chamber inflow line, so that the desired injection quantity, determined by the fuel metering device, can be delivered to the pressure chamber. After that, the metering conduit is blocked via an annular shaft of the pump piston, so that then in the terminal position of the intake stroke, in accordance with a detent portion of the cam, the metering conduit can be made to communicate with the pump chamber and introduce into it the quantity defined by the fuel metering device, which determines the supply onset. The free piston dividing the pump chamber and pressure chamber assumes any arbitrary intermediate position at this time, because voids are created during the intake stroke in both the pressure chamber and the pump chamber, to the extent that the intake stroke of the pump piston is greater than the fuel quantities necessary to fill the two chambers. The void formation is typically at an extreme, particularly in the pressure chamber, at the onset of fuel metering into the pump chamber.

The largely uncontrolled "floating" of the free piston, at high rpm, or in other words high piston speeds, can cause deviations in the metering of the fuel quantity into the pressure chamber or the pump chamber, because the quantity of fuel flowing through the metering device is determined both by the cross section and by the pressure of the fuel source, and because of mass acceleration or inertia the mass of the free piston can have an rpm-dependent effect. A further factor is that these rpm-dependent mass factors can cause the void in the pressure chamber to be larger than in the pump chamber, so that when the fuel quantity determining the supply onset is metered into the pump chamber, there may not be enough room available, or the pumping might have to be performed counter to the pumping action of the free piston dictated by the acceleration of the free piston.

For this reason, in another, quite similar fuel injection device (German Offenlegungsschrift 37 00 359), a spring-loaded intermediate piston is provided instead of the free piston; via the fuel metering device, the fuel quantity determining the supply onset is first metered into the pump chamber, and as the intake stroke continues, after the reversal of either the pump piston or the intermediate piston, the quantity of fuel to be injected is metered into the pressure chamber. During the fuel metering into the pump chamber, the intermediate piston is largely kept in its outset position by the pressure of the fuel flowing into the pump chamber, or in other words by the pressure of the fuel source, counter to the force of the spring, and then after the termination of fuel metering into the pump chamber (or in other words after the termination of the metering of the fuel quantity determining the supply onset) is displaced by the spring in accordance with the continued intake stroke of the pump piston. Once the maximum stroke has been executed, this intermediate piston strikes a stop. In this terminal position, the pressure chamber inflow line is opened by the intermediate piston, while the pump piston continues its intake stroke to the end. In this continued intake stroke, a void is initially created in the pump chamber—on account of the stoppage of the intermediate piston because of the stop—and second, the fuel that is to be injected is now metered into the void, created by the spring, in the pressure chamber. Although the void at the beginning of metering of the quantity of fuel to be injected is of equal size at each injection cycle, effects of the metering that determines the supply onset do exist, because the intake stroke of the intermediate piston always begins whenever the metering into the pump chamber that determines the supply onset has ended. The difference in pressure between the pressure of the fuel source and the negative pressure in the pressure chamber varies in the course of the metering of fuel into the pressure chamber, because as it fills, the negative pressure decreases correspondingly, so that this also has an effect on the timing control or in other words on the metering defined over time. To reduce this influence, a throttle is provided in this pressure chamber inflow line; the throttle effects a certain backup of the fuel source pressure compared with the pressure chamber negative pressure and thus effects a certain decoupling. Not only is there the disadvantage that metering is done into a void of variable negative pressure, but the total stroke of the pump piston is not favorably exploited, either. A further disadvantage is that such a spring is structurally complicated and particularly difficult to manufacture, which makes it expensive.

OBJECT AND SUMMARY OF THE INVENTION

The fuel injection device according to the invention has an advantage over the prior art that during the metering stroke for the injection quantity, the free piston is fastened in a position located between positions that would determine fuel quantities of different pressure; this enables controlled metering of the injection quantity, with less influence by disruptive factors. While errors in the supply onset adjustment would not necessarily be damaging, errors in fuel metering would have considerably greater disadvantages: not only poorer efficiency but also an increase in the proportion of toxic exhaust gas, and in particular in the proportion of soot. This avoidance of void formation applies to the entire intake stroke portion that meters the quantity of fuel to be injected. Only once this decisive fuel metering stroke has ended is a change made from this metering stroke, dependent on the maximum possible injection quantity, directly to the control stroke of the pump piston, in which, while the intake stroke of the pump piston is still taking place, the quantity of fuel determining the supply onset is metered into the pump chamber. The result is a markedly increased freedom in design for ways to vary the course of injection. Since the free piston remains in contact with the pump piston during the metering stroke, an exact, combined rotational angle and timing control is achieved here, in which additional transducers for disturbance factors can be dispensed with; the control is particularly good at higher rpm.

In an advantageous feature of the invention, the maintenance pressure chamber is supplied with fuel from the fuel source of low pressure (suction chamber, metering fuel), and the decrease from metering pressure to maintenance pressure is attained via a pressure control valve. In principle, it is in fact conceivable for two different fuel sources of different pressure to be used. As a result of this specialized embodiment, not only are the hydraulic pressures more easily regulated, but also exact initial conditions prevail during each intake stroke. Naturally the corresponding pressure stage can also be attained by providing that fuel flows constantly via a throttle out of the suction chamber into the maintenance pressure chamber, and that the maintenance pressure is regulated via control of the outflow from the maintenance pressure chamber.

In another advantageous feature of the invention, the pressure control valve is embodied as a slide valve, which is disposed between the suction chamber so that as the fuel source is at metering pressure and the maintenance chamber which is at maintenance pressure, the slide valve opening toward the maintenance chamber; in one displacement direction, its control slide is acted upon by the metering pressure and in the other by both the maintenance pressure and a pressure control spring. Such a slide valve can be disposed directly in the pump housing of the pump piston, in order to attain short fuel conduits, and can also be designed in the most various ways in terms of the control cross section; in particular, it can also have correction elements.

In yet another advantageous feature of the invention, a certain fuel quantity flows continuously without pressure out of the maintenance pressure chamber via at least one outflow throttle of a predetermined cross section. As a result, a continuous thorough scavenging, required for exact pressure regulation, of both the pressure control valve and the control chambers is attained, with simultaneous prevention of a pressure backup in the maintenance pressure chamber.

In a further advantageous feature of the invention, the shaft of the pump piston serves in a manner known per se as a control device; at least one annular groove is disposed in the jacket face of the pump piston, and an annular shaft segment of known width, which is equivalent to the width of an inner annular groove present in the cylinder bore that receives the pump piston and communicates continuously with the metering conduit, so that during the metering stroke this inner annular groove communicates via the outer annular groove and a pressure chamber inflow line with the pressure chamber, and then upon the reversal by the annular shaft segment it is separated from it and blocked, and during the control stroke communicates via a control conduit with the pump chamber. It is conceivable in this respect for the metering conduit to be opened directly toward the pump chamber during the control stroke, for example by providing that the lower face edge of the pump piston is simultaneously the end of the annular shaft. In such a case, however, the maintenance pressure line would have to be blocked by suitable means upon the reversal from the metering stroke to the control stroke, to prevent the undesirable flow of fuel back out of the pump chamber.

In another advantageous feature of the invention, an annular control groove therefore adjoins the annular shaft on the pump piston shaft in the direction of the pump chamber; this annular control groove communicates continuously with the control conduit leading to the pump chamber and communicates during the metering stroke with the maintenance pressure line; alternatively, it is separated from the maintenance pressure line during the control stroke and communicates with the metering conduit. Providing such an annular control groove is particularly easy to do from the production standpoint, because an outer annular groove must be present in any case.

In another advantageous feature of the invention, the maintenance pressure line is blocked by the pump piston during the pump piston stroke only shortly after the pressure chamber inflow line, or shortly after the control conduit was connected to the metering conduit. This prevents the possibility of the creation of a void upon the reversal in the pump chamber, and mixups between the metering of the injection quantity and the metering of the quantity determining the supply onset cannot occur.

In another advantageous feature of the invention, a check valve opening in the direction of the pump chamber is disposed in the control conduit, and in a corresponding manner a check valve opening toward the pressure chamber is disposed in the pressure chamber inflow line. Although these check valves would not be necessary from the standpoint of the control principle, they effect an improved separation of the conduits, and thus above all effect a decoupling of the high-pressure chambers during the pump piston compression stroke in favor of the low-pressure chambers of the control region, in particular of the fuel metering device, which advantageously comprises a magnetic valve.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
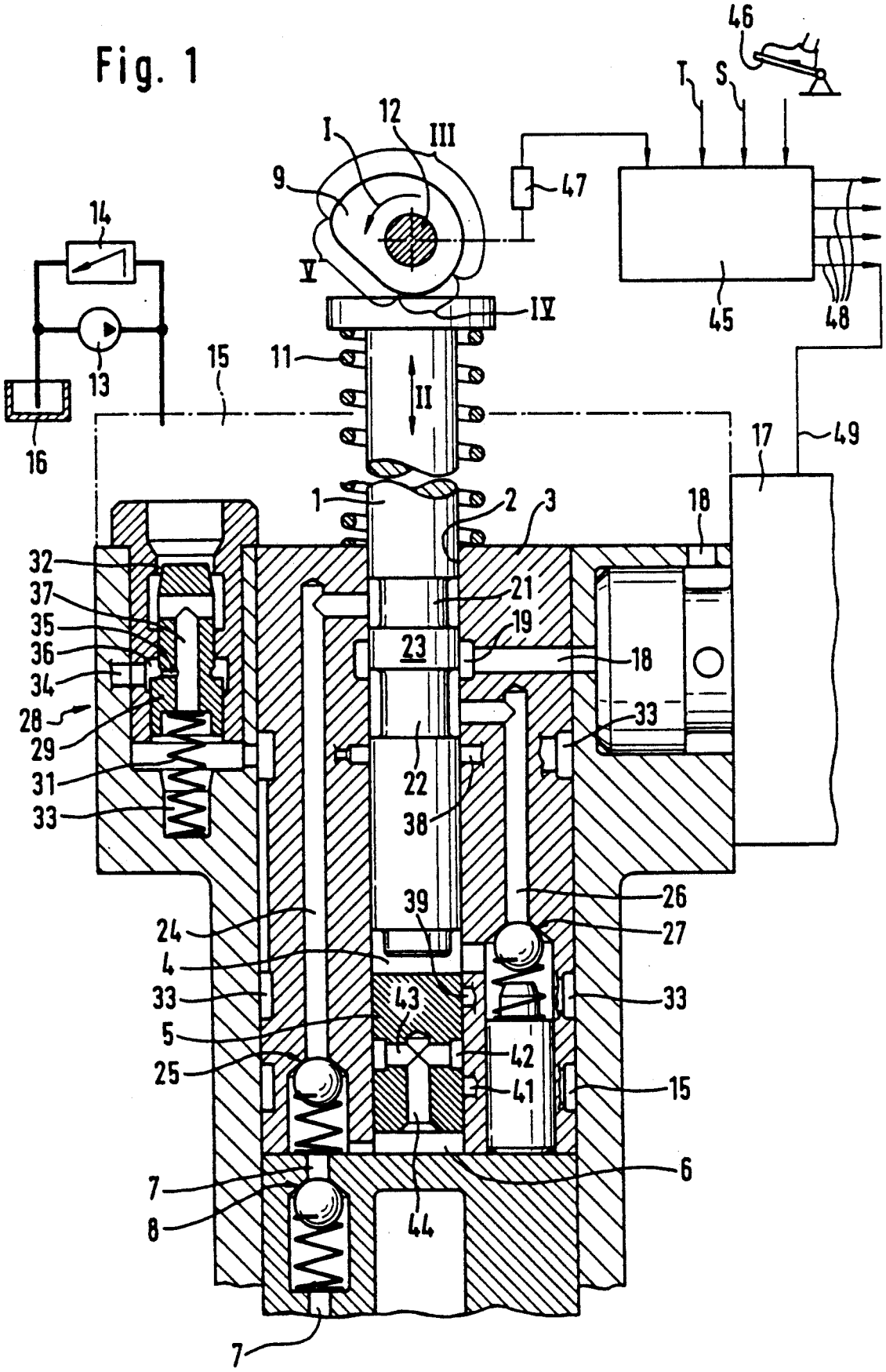
FIG. 1 shows the first exemplary embodiment of an injection system having a unit fuel injector, essential parts of which are shown in longitudinal section.
Figure 2:
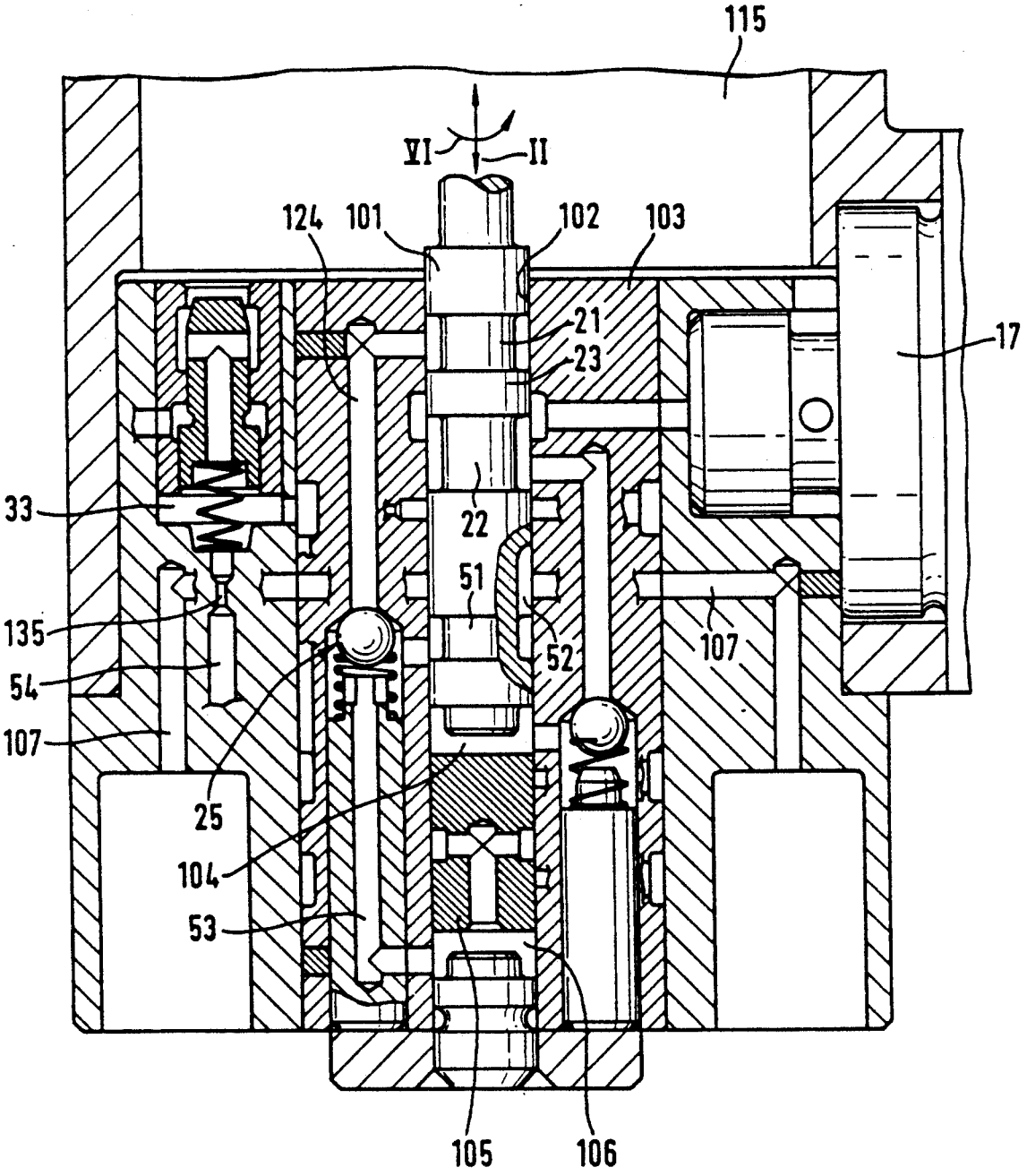
FIG. 2 shows a second exemplary embodiment, specifically only the pump and control device thereof, in longitudinal section.

In the injection devices shown in FIGS. 1 and 2, a pump piston 1, 101 operates in a cylinder bore 2, 102 of a pump housing 3, 103 and defines a pump chamber 4, 104, which is defined on the other end by a free piston 5, 105, that is disposed, axially freely displaceably, in the cylinder bore 2, 102. Under the free piston 5, a pressure chamber 6 of the pump is provided, from which fuel is pumped during the compression stroke to the injection nozzle, not shown. In the first exemplary embodiment shown in FIG. 1, the pump piston 1 is driven solely to reciprocate, while in the second exemplary embodiment shown in FIG. 2 a rotational motion is superimposed on this reciprocating motion; preferably, the pump piston 101 executes as many stroke per revolution as there are engine cylinders to be supplied with fuel.

In the first exemplary embodiment shown in FIG. 1, a pressure conduit 7 that leads to an injection nozzle (not shown) on the engine branches off from the pressure chamber 6. A pressure valve 8 opening toward the injection nozzle is disposed in this pressure conduit 7, having a somewhat elevated opening pressure, so that it remains closed during the fuel metering into the pressure chamber 6, as will be described below, and opens only during the injection pumping.

The pump piston 1 is driven for its reciprocating pumping motion, represented by a double arrow II, by a drive cam 9 rotating in the direction of the arrow I, counter to the force of a restoring spring 11. The drive cam 9 is disposed on a camshaft 12, which preferably also has the cams with which the valves of the associated engine are driven. In each case, this camshaft 12 rotates at an rpm corresponding to the engine rpm. In the normal situation, one such unit, having a pump piston 1, is assigned to each engine cylinder.

These high-pressure pump units are associated with a low-pressure fuel system, having a feed pump 13 and a pressure maintenance valve 14; this system pumps fuel into a suction chamber 15, represented by dot-dash lines, and the fuel to be metered is drawn off from it. The pressure in the suction chamber 15, as a metering pressure, is sufficiently high to serve to provide fuel metering in the pump chamber and pressure chamber. The feed pump 13 aspirates the fuel from a fuel container 16, into which the leakage lines, not shown in further detail, discharge.

The free piston 5 in principle separates the pump chamber 4 from the pressure chamber 6; that is, no short-circuit line is present. Fuel is metered into each of the two work chambers 4 and 6, in each case during a different portion of the intake stroke of the pump piston 1, via a metering device that in these examples is embodied as a magnetic valve 17. This magnetic valve 17 is incorporated into a metering conduit 18 that discharges into an inner annular groove 19 of the cylinder bore 2. Reversed via the shaft of the pump piston 1, this inner annular groove 19 is made to communicate with the pressure chamber 6 in the first portion of the intake stroke, which here is designated as the metering stroke, and then in a second intake stroke portion, here designated the control stroke, is made to communicate with the pump chamber 4. While only the quantity of fuel that is later to be injected upon the later compression stroke of the pump piston 1 is metered into the pressure chamber 6 during the metering stroke with the magnetic valve 17 open, during the control stroke, via the magnetic valve 17 opened at the proper time for this, a quantity of fuel that determines the supply onset is metered into the pump chamber 4. The free piston 5 is never driven for its pumping stroke, in which it positively displaces fuel out of the pressure chamber 6, until any voids in the pump chamber 4 have been compensated for after the beginning of the compression stroke of the pump piston, and the remaining fuel quantity in the pump chamber 4, as a theoretically incompressible fluid, drives the free piston 5. The larger the control quantity stored in the pump chamber 4 ahead of time, the earlier the injection begins, for a particular metering quantity in the pressure chamber. Naturally the supply onset also depends fundamentally on the quantity of fuel stored beforehand in the pressure chamber 6 for the injection. In the final analysis, the supply onset is determined by adding the two quantities, that is, by the fill ratio of the pump chamber 4, plus the fill ratio of the pressure chamber 6. The extreme cases are a very early supply onset at maximum injection quantity, as is the case for instance at full load, and an extremely late supply onset at a very low rpm, as is for instance the case during idling.

To control the inner annular groove 19, an outer annular groove 21 for metering fuel to the pressure chamber 6 and an annular control groove 22 that controls the communication with the pump chamber 4 are both disposed on the jacket face of the pump piston 1. Between the two annular grooves 21 and 22, an annular shaft segment 23 is provided, which has approximately the same width as the inner annular groove 19. The entrance to a pressure chamber inflow line 24 coincides constantly with the outer annular groove 21; at its other end it discharges into the pressure chamber 6, and a check valve 25 opening toward the pressure chamber 6 is disposed in this inflow line 24. On the other hand, the entrance to a control conduit 26 coincides constantly with the annular control groove 22 and on its other end discharges into the pump chamber 4; a check valve 27 opening toward the pump chamber 4 is disposed in it. Upon the intake stroke of the pump piston 1, during the metering stroke the inner annular groove 19 coincides with the outer annular groove 21, and then immediately reverses, and during the ensuing control stroke is separated from the outer annular groove 21 and communicates with the annular control groove 22. Depending on how long the magnetic valve 17 is open during these working strokes, fuel flows during the metering stroke out of the suction chamber 15 via the metering conduit 18 and the magnetic valve 17, the inner annular groove 19 and the outer annular groove 21, and the pressure chamber inflow line 24 and check valve 25 into the pressure chamber 6, and during the control stroke fuel flows from the suction chamber 15 via the metering conduit 18, the magnetic valve 17, the inner annular groove 19, the annular control groove 22, the control conduit 26 and the check valve 27 into the pump chamber 4. The magnetic valve 17 can open and close again within either the metering stroke or the control stroke, or the motion of the pump piston 1 can be used as a control device and in each case can already be opened whenever the communication between the inner annular groove 19 and the outer annular groove 21 or the annular control groove 22 is switched over by the annular shaft segment 23, so that the first segment of the opening period of the magnetic valve 17 is used for the metering quantity, while the second portion contrarily is used for the quantity determining the supply onset.

In order that the free piston 5 will execute a controlled motion during the metering stroke, the pump chamber 4 is kept at a predetermined fuel pressure, which is lower than the metering pressure that is transmitted from the pump chamber 4, so that during the metering of fuel into the pressure chamber 6, the free piston 5 is displaced only in accordance with the metered quantity that is later to be injected. This fuel pressure to be brought to bear in the pump chamber will hereinafter be called the maintenance pressure. Necessarily, this maintenance pressure can exist only until the end of the metering stroke in the pump chamber 4, because after that, from the beginning of the control stroke, fuel is carried at metering pressure into the pump chamber 4.

The maintenance pressure is controlled by a pressure control valve 28, which operates with a control slide 29 that is acted upon on one side by metering pressure from the suction chamber 15 and on the other is acted upon by the maintenance pressure and by a pressure control spring 31. As soon as the maintenance pressure drops, the control spring 29 is displaced counter to the force of the pressure control spring 31 in accordance with the altered pressure difference between the metering pressure and the maintenance pressure, and in this process opens the control cross section 32, until the maintenance pressure has attained the desired magnitude. To provide uniform control despite varying fuel volumes on the maintenance pressure side, a pressureless outflow conduit 34, for instance discharging into the fuel container 16, branches off from the maintenance pressure chamber 33, and an outflow throttle 35 is disposed in this conduit in order to enable maintaining the maintenance pressure in the maintenance pressure chamber 33. The control slide 9 is embodied as a stepped piston, which is guided in a corresponding stepped bore, the face end of smaller diameter of which is acted upon by metering pressure and the face end of larger diameter is acted upon by maintenance pressure, while in the region of the step an outflow chamber 36 is provided, from which the outflow conduit 34 branches off. A longitudinal blind bore 37 is also disposed in the control slide 29; this bore is open toward the maintenance pressure chamber 33 and the outflow throttle leads away from it to the outflow chamber 36.

Branching off from the maintenance pressure chamber 33 is a maintenance pressure line 38, which intersects the cylinder bore 2 of the pump piston 1 and during the metering stroke coincides with the control annular chamber 22, but is separate from it during the control stroke. During the metering stroke, the maintenance pressure is accordingly carried from the maintenance pressure chamber 33 into the pump chamber 4, via the maintenance pressure line 38, the annular control groove 22 and the control conduit 26 as well as the check valve 27, so that during this portion of the intake stroke maintenance pressure prevails in the pump chamber 4, counteracting the higher metering chamber in the pressure chamber 6.

Branching off from the cylinder bore 2 are a relief conduit 39 and a diversion conduit 41, which are each opened up by the free piston 5, close to its terminal position of the pressure stroke, i.e. the outset position of the intake stroke; via the relief conduit 39, which is opened by the upper control edge of the free piston 5, the pump chamber 4 is pressure-relieved toward the maintenance chamber 33, and via the diversion conduit 41, the pressure chamber 6 can be opened toward the suction chamber 15. For controlling the diversion conduit 41, an annular groove 42 disposed on the jacket face of the free piston 5 is provided; it communicates with the pressure chamber 6 via a transverse bore 43 and a blind bore 44 each of which extends in the free piston 5.

The magnetic valve 17, as a fuel metering device, is triggered by an electronic control unit 45, in order to determine the particular fuel quantity to be metering and to the pressure chamber 6 and into the pump chamber 4, and as a result to regulate the supply onset or engine rpm. The load is supplied to this electronic control unit 45 via a gas pedal 46; the rpm n is fed to it via an rpm transducer 47; and the temperature t and a further variable s, such as an exhaust gas value or an ambient pressure value, are fed to this unit via at least two further transducers, not shown. The actual supply onset can be measured via a transducer present on the injection nozzle. Of the outputs 48 of the electronic control unit 45, one output leads to the magnetic valve 17 via an electric line 49, as shown, while the other three outputs 48 each lead to a different unit fuel injector, each having one magnetic valve 17, assuming a four-cylinder engine.

The course of motion of the drive cam 9 is divided into three segments: a relatively long intake stroke zone III of little slope (intake stroke flank), a short resting portion IV (base circle of the cam), and a steep pressure stroke segment V (pressure stroke flank). In the operating position shown, the base circle of the cam is just now acting upon the pump piston 1, shortly before the pressure stroke flank V comes into action. In conjunction with the rotational motion of the drive cam 9, the operation of this first exemplary embodiment shown in FIG. 1 will now be described:

In the position shown, the pump piston assumes its top dead center position, corresponding to a terminal position after its intake stroke and an outset position before its compression stroke.

Upon further rotation of the drive cam 9 in the direction of the arrow I, the compression stroke flank V comes into action upon the pump piston 1 and actuates it downward for its compression stroke. During a first pressure stroke segment, any possible void present in the pump chamber 4 is compensated for, after which the free piston 5 is carried along downward as well by the virtually incompressible fluid in the pump chamber and pumps the pre-stored fuel out of the pressure chamber to the engine via the pressure conduit and the pressure valve 8. The smaller the void in the pump chamber 4, this earlier this supply accordingly begins.

Toward the end of this supply stroke of the pump piston 1 and free piston 5, the relief conduit 39 of the pump chamber 4 is opened toward the maintenance chamber 33 by the upper edge of the free piston 5, and the annular groove 42 opens the diversion conduit 41 of the pressure chamber 46 toward the suction chamber 15. This diversion of the pressure chamber 6 takes place shortly before the relief of the pump chamber 4, so that a defined terminal position of the free piston 5 is provided whenever the pump piston 1 is still pumping quantities of fuel located in the pump chamber 4 via the relief conduit. After that, upon the end of the compression stroke of the pump piston 1, the maintenance pressure is established in the pump chamber 4, while contrarily in the pressure chamber 6 the higher metering pressure is established, as a result of which the free piston 5 is pushed against the pump piston 1 in each case.

At the intake stroke flank III of the drive cam 9 that now comes into action, the fuel metering into the two work chambers takes place. As soon as the magnetic valve 17 opens, the suction chamber 15 is made to communicate with the pressure chamber 6 in the manner described above, so that fuel flows in. The free piston 5 in this process follows along precisely with the intake stroke motion of the pump piston 1, because during this first metering stroke the maintenance pressure chamber 33 communicates with the pump chamber 4, and therefore only the lower maintenance pressure prevails there. As soon as the desired injection quantity has been metered into the pressure chamber 6, the magnetic valve 17 closes, and the free piston 5 separates from the pump piston 1, whereupon fuel continues to flow at maintenance pressure into the pump chamber 4. Accordingly in this metering stroke both work chambers 4 and 6 are always filled with fuel; the particular fill quantity depends on how much injection fuel was metered into the pressure chamber. In the extreme case, the free piston 5 remains in contact with the pump piston 1 until the end of the metering stroke. As soon as the maintenance pressure line 38 is then disconnected from the annular groove 42 in the course of the further intake stroke, in other words at the beginning of the control stroke, the suction chamber 15 is simultaneously made to communicate with the pump chamber 4, as long as the magnetic valve 17 is opened, so that metering pressure now prevails in the pump chamber. As soon as the fuel quantity determining the supply onset has been metered, the magnetic valve 17 closes, even though the intake stroke of the pump piston 1 continues; in this process a void can form in the pump chamber 4 or possibly in the pressure chamber 6. The disconnection of the maintenance line 38 from the annular groove 22 takes place only shortly after the metering conduit 18 was disconnected from the pressure chamber inflow line 24 or connected to the control conduit 26. In any case, only a safety overlap is involved here, which assures that the free piston 5 always remains fastened between two hydraulic cushions, so that no void can be created in the pressure chamber 6 during the metering of the fuel injection quantity.

In the second exemplary embodiment shown in FIG. 2, a distributor pump is used as the basic pump; its function, insofar as it relates to the invention, is the same as in FIG. 1. In principle, all of the parts that are embodied like those of the first exemplary embodiment are provided with the same reference numerals, while parts that have the same function but a different design are identified by the same number, raised by 100. For instance, the pump piston is 101, because for its drive it executes not only the reciprocating motion II but also a rotating motion VI, and because in addition to the outer annular groove 21, the ring shaft segment 23 and the annular control groove 22, it additionally has an annular distributor groove 51, branching off from which is a longitudinal distributor groove 52, which is disposed on the jacket face of the piston 101 and during a rotation of the pump piston 101 opens as many pressure conduits 107 as there are cylinders of the engine to be supplied with fuel. The number of reciprocating strokes performed during one revolution of the pump piston 101 also matches this number of cylinders to be supplied. Pressure valves, not shown, are disposed in the pressure conduits 107 and by way of them the fuel is pumped to the injection nozzle with the engine during the compression stroke of the pump piston 101. To enable the fuel to flow to the annular distributor groove 51 during the compression stroke, the check valve 25 is shifted farther upward, and a connecting conduit 53 is provided by way of which, during the metering stroke, fuel can flow from the pressure chamber inflow line 124 into the pressure chamber 6, and then during the compression stroke it can be pumped back out of the pressure chamber 6 to the annular distributor groove 51. During the metering stroke, there is no communication between the longitudinal distributor groove 52 and one of the pressure conduit 107, so that even though a constant communication of this connecting conduit 53 with the longitudinal distributor groove 51 exists, no incorrect change is made in the quantity of fuel metered from the suction chamber 115 via the magnetic valve 17 and later intended to be injected.

In this exemplary embodiment, an outflow conduit 54 branches off from the maintenance pressure chamber 33; disposed in this conduit is the outflow throttle 135, which in principle is equivalent to the arrangement in the first exemplary embodiment having the outflow chamber 36. Otherwise, in terms of its control function and above all in terms of the fastening according to the invention of the free piston 5 during the metering stroke located at the beginning of the intake stroke, this second exemplary embodiment functions precisely like the first exemplary embodiment.

All the characteristics described here, recited in the following claims and shown in the drawing may be essential to the invention either individually or in an arbitrary combination with one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection device comprising a housing, a cylinder bore (2, 102) in said housing, a pump piston (1, 101) in said cylinder bore driven for a reciprocating motion by a drive cam (9), a fuel chamber formed by said pump piston and said cylinder bore, a free piston that has the same diameter as the pump piston operative in said fuel chamber and driven coaxially with said pump piston, said free piston hydraulically separates said fuel chamber into a pressure chamber (6, 106) and pump chamber (4, 104), said pressure chamber supplies an injection nozzle with fuel via a pressure line, and near an end of a compression stroke, said free piston opens a relief conduit (39) of said pump chamber and a diversion conduit of said pressure chamber, a fuel metering device (17) by means of which a quantity of fuel to be injected is metered into the pressure chamber from a fuel source of low pressure via a metering conduit (18) during a metering stroke in a portion of an intake stroke of said pump piston, said fuel metering device in combination with a later control stroke of said pump piston meters a quantity of fuel into the pump chamber, that determines the onset of supply of the injection quantity delivered from the pressure chamber (6, 106), fuel control means that operate synchronously with the pump piston, by means of said control means, said metering conduit downstream of said metering device can be made to communicate with said pump chamber or with said pressure chamber, a maintenance pressure chamber (33) that communicates with said pump chamber via a maintenance pressure line, said maintenance pressure chamber (33) provides a maintenance pressure fuel source to said pump chamber (4) via said maintenance pressure line; and said pump piston (1, 101) provides a fuel intake stroke which includes a metering stroke followed by a control stroke;

during the metering stroke, a maintenance pressure that is lower than the metering pressure prevails in the pump chamber (4, 104), upon a transition from the metering stroke to the control stroke, said metering conduit (18) is switched over directly from said pressure chamber (6, 106) to said pump chamber (4, 104), and said maintenance pressure line (38) is blocked by said control pump means toward an end of the metering stroke.

2. A fuel injection device as defined by claim 1, in which said maintenance pressure chamber (33) is supplied with fuel from a low-pressure fuel source (suction chamber 15), with a pressure reduction from the metering pressure to maintenance pressure being effected by pressure control valve (28).

3. A fuel injection device as defined by claim 2, in which said pressure control valve (28) is embodied as a slide valve, having a control slide (29) acted upon on one face end by the metering pressure and on another face end by the maintenance pressure and acted upon by a pressure control spring (31).

4. A fuel injection device as defined by claim 3, in which said control slide (29) is embodied as a stepped piston and operates in a corresponding stepped bore, wherein the face end of larger diameter is oriented toward the maintenance pressure chamber (33), said pressure control valve includes an outflow chamber (36) formed by said stepped piston which is pressure-relieved via an outflow conduit (34) to said suction chamber (15).

5. A fuel injection device as defined by claim 3, which includes an outflow throttle (35) of constant cross section through which a leakage quantity drains out continuously, without pressure, from the maintenance pressure chamber (33).

6. A fuel injection device as defined by claim 4, which includes an outflow throttle (35) of constant cross section through which a leakage quantity drains out continuously, without pressure, from the maintenance pressure chamber (33).

7. A fuel injection device as defined by claim 5, in which said outflow throttle (35) is disposed between the maintenance pressure chamber (33) and the outflow chamber (36).

8. A fuel injection device as defined by claim 6, in which said outflow throttle (35) is disposed between the maintenance pressure chamber (33) and the overflow chamber 36.

9. A fuel injection device as defined by claim 1, in which said control means is formed by at least one recess (21, 22) present on a jacket face of said pump piston that cooperate with orifices of control conduits (18, 19, 24, 26, 38).

10. A fuel injection device as defined by claim 4, in which said control means is formed by at least one recess (21, 22) present on a jacket face of said pump piston that cooperate with orifices of control conduits (18, 19, 24, 26, 38).

11. A fuel injection device as defined by claim 5, in which said control means is formed by at least one recess (21, 22) present on a jacket face of said pump piston that cooperate with orifices of control conduits (18, 19, 24, 26, 38).

12. A fuel injection device as defined by claim 7, in which said control means is formed by at least one recess (21, 22) present on a jacket face of said pump piston that cooperate with orifices of control conduits (18, 19, 24, 26, 38).

13. A fuel injection device as defined by claim 9, in which said at least one recess is an outer annular groove (21) present in the jacket face of said pump piston, which outer annular groove on one side defines an annular shaft segment (23) of a predetermined width, which is equivalent to a width of an inner annular groove (19) present in said cylinder bore (2, 102) which receives the pump piston (1, 101), said inner annular groove (19) communicates at all times with the metering conduit (18), so that said inner annular groove (19) communicates during the metering stroke via the outer annular groove (21) and a pressure chamber inflow line (24) with the pressure chamber (6), and said inner annular groove (19) upon a reversal in movement of said pump piston and the annular shaft segment (23) is separated from said outer annular groove (21) and blocked, in order to then communicate during the control stroke with the pump chamber (4) via a control conduit (26).

14. A fuel injection device as defined by claim 13, which includes a second outer annular groove (22) in said pump piston that adjoins the annular shaft segment (23) in a direction toward the pump chamber (4) said second annular outer groove communicates at all times with the control conduit (26) leading to the pump chamber (4) and communicates during the metering stroke with the maintenance pressure line (38), but contrarily during the control stroke is disconnected from the maintenance pressure line and communicates with the metering conduit (18).

15. A fuel injection device as defined by claim 14, in which during the intake stroke the maintenance pressure line (38) is blocked only shortly after the pressure chamber inflow line (24), or shortly after the control conduit (26) was made to communicate with the metering conduit (18).

16. A fuel injection device as defined by claim 1, which includes a check valve (27) disposed in the control conduit (26) that opens in a direction of the pump chamber.

17. A fuel injection device as defined claim 1, which includes a check valve (25) disposed in the pressure chamber inflow line (24, 124) that opens in a direction of the pressure chamber (6).

18. A fuel injection device as defined by claim 1, in which a single magnetic valve (17) serves as the fuel metering device.

19. A fuel injection device as defined claim 1, in which said free piston (5) opens diversion conduit (41) of the pressure chamber (6), upon the compression stroke of the pump piston (1, 101), earlier than the relief conduit (39) of the pump chamber (4).

20. A fuel injection device as defined by claim 1, in which said relief conduit (39) of the pump chamber (4) discharges into the maintenance pressure chamber (33).

21. A fuel injection device as defined by claim 1, in which said diversion conduit (41) of the pressure chamber (6) discharges into a suction chamber (15).

22. A fuel injection device as defined by claim 1, in which said pump piston (101) is embodied as a pump and distributor piston and includes means for setting said pump piston in a simultaneous reciprocating and rotating motion, wherein during the compression stroke dependent on a rotational position of the pump piston (101), the pressure chamber (6) communicates with one at a time of a plurality of pressure conduits (107) via an annular distributor groove (51) and a longitudinal distributor groove (52).

* * * * *